US009990936B2

(12) United States Patent
Ozerov et al.

(10) Patent No.: US 9,990,936 B2
(45) Date of Patent: Jun. 5, 2018

(54) METHOD AND APPARATUS FOR SEPARATING SPEECH DATA FROM BACKGROUND DATA IN AUDIO COMMUNICATION

(71) Applicant: THOMSON LICENSING, Issy les Moulineaux (FR)

(72) Inventors: Alexey Ozerov, Rennes (FR); Quang Khanh Ngoc Duong, Rennes (FR); Louis Chevallier, La Meziere (FR)

(73) Assignee: THOMSON Licensing, Issy-les-Moulineaux (FR)

( * ) Notice: Subject to any disclaimer, the term of this patent is extended or adjusted under 35 U.S.C. 154(b) by 0 days. days.

(21) Appl. No.: 15/517,953

(22) PCT Filed: Oct. 12, 2015

(86) PCT No.: PCT/EP2015/073526
§ 371 (c)(1),
(2) Date: Apr. 8, 2017

(87) PCT Pub. No.: WO2016/058974
PCT Pub. Date: Apr. 21, 2016

(65) Prior Publication Data

US 2017/0309291 A1 Oct. 26, 2017

(30) Foreign Application Priority Data

Oct. 14, 2014 (EP) ..... 14306623

(51) Int. Cl.
*G10L 21/028* (2013.01)

(52) U.S. Cl.
CPC ..... *G10L 21/028* (2013.01)

(58) Field of Classification Search
None
See application file for complete search history.

(56) References Cited

U.S. PATENT DOCUMENTS

| | | | | |
|---|---|---|---|---|
| 5,946,654 | A | 8/1999 | Newman et al. | |
| 6,766,295 | B1 | 7/2004 | Murveit et al. | |
| 8,121,837 | B2 * | 2/2012 | Agapi | G10L 21/0208 704/233 |

(Continued)

FOREIGN PATENT DOCUMENTS

EP 1564722 8/2005

OTHER PUBLICATIONS

Anonymous, "Audio Noise Reduction Software Solutions", SoliCall, http://solicali.com/Audio-Noise-Reduction- Software-Solutions, Aug. 1, 2014, p. 1.

(Continued)

*Primary Examiner* — Paul Huber
(74) *Attorney, Agent, or Firm* — Brian J. Dorini; Jeffrey M. Navon

(57) ABSTRACT

A method and an apparatus for separating speech data from background data in an audio communication are suggested. The method comprises: applying a speech model to the audio communication for separating the speech data from the background data of the audio communication; and updating the speech model as a function of the speech data and the background data during the audio communication.

13 Claims, 4 Drawing Sheets

(56) References Cited

U.S. PATENT DOCUMENTS

| | | | | |
|---|---|---|---|---|
| 2003/0191636 | A1* | 10/2003 | Zhou | G10L 15/065 704/226 |
| 2007/0021958 | A1 | 1/2007 | Visser et al. | |
| 2010/0027767 | A1* | 2/2010 | Gilbert | H04M 3/42221 379/88.03 |
| 2013/0332165 | A1 | 12/2013 | Beckley et al. | |
| 2014/0249812 | A1* | 9/2014 | Bou-Ghazale | G10L 25/84 704/233 |

OTHER PUBLICATIONS

Duan et al., "Online PLCA for Real-Time Semi-supervised Source Separation", International Conference on Latent Variable Analysis and Signal Separation, Tel Aviv, Israel, Mar. 12, 2012, pp. 34-41.

Anonymous, "Personalized Noise Reduction for Mobile Phones", SoliCall, http://solicall.com/personal-noise-reduction-for-mobile-phones/, Jan. 24, 2014, pp. 1-3.

Anonymous, "Registering a Personal Voice Profile", SoliCall, http://solicall.com/registering-a-personal-voice-profile/, Aug. 5, 2013, pp. 1-5.

Anonymous, "FAQ—Noise Reduction & Echo Cancellation for VoIP", SoliCall, http://solicall.com/faq/, Aug. 1, 2014, pp. 1-6.

Boll, "Suppression of Acoustic Noise in Speech Using Spectral Subtraction", IEEE Transactions on Acoustics, Speech, and Signal Processing, vol. 27, No. 2, Apr. 1979, pp. 113-120.

Ephraim et al., "Speech Enhancement Using a Minimum-Mean Square Error Short-Time Spectral Amplitude Estimator", IEEE Transactions on Acoustics, Speech, and Signal Processing, vol. 32, No. 6, Dec. 1984, pp. 1109-1121.

Simon et al., "A General Framework for Online Audio Source Separation", International Conference on Latent Variable Analysis and Signal Separation, Tel Aviv, Israel, Mar. 12, 2012, pp. 1-9.

Ozerov et al., "Adaptation of Bayesian Models for Single-Channel Source Separation and its Application to Voice/Music Separation in Popular Songs", IEEE Transactions on Audio, Speech, and Language Processing, vol. 15, No. 5, Jul. 2007, pp. 1564-1578.

* cited by examiner

METHOD AND APPARATUS FOR SEPARATING SPEECH DATA FROM BACKGROUND DATA IN AUDIO COMMUNICATION

This application claims the benefit, under 35 U.S.C. § 365 of International Application PCT/EP2015/073526 filed Oct. 12, 2015, which was published in accordance with PCT Article 21(2) on Apr. 21, 2016, in English, and which claims the benefit of European Application No 14306623.1 filed Oct. 14, 2014. The European and PCT applications are expressly incorporated by reference herein in their entirety for all purposes.

TECHNICAL FIELD

The present invention generally relates to the suppression of acoustic noise in a communication. In particular, the present invention relates to a method and an apparatus for separating speech data from background data in an audio communication.

BACKGROUND

This section is intended to introduce the reader to various aspects of art, which may be related to various aspects of the present disclosure that are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

An audio communication, especially a wireless communication, might be taken in a noisy environment, for example, on a street with high traffic or in a bar. In this case, it is often very difficult for one party in the communication to understand the speech due to a background noise. It is therefore an important topic in the audio communication to suppress the undesirable background noise and at the same time to keep the target speech, which will be beneficial to enhance the speech intelligibility.

There is a far-end implementation of the noise suppression where the suppressing is implemented on the communication device of the listening person and a near-end implementation where it is implemented on the communication device of the speaking person. It can be appreciated that the mentioned communication device of either the listening or the speaking person can be a smart phone, a tablet, etc. From the commercial point of view the far-end implementation is more attractive.

The prior art comprises a number of known solutions that provide noise suppression for an audio communication.

One of the known solutions in this respect is called speech enhancement. One exemplary method was discussed in the reference written by Y. Ephraim and D. Malah, "Speech enhancement using a minimum mean square error short-time spectral amplitude estimator." IEEE Trans. Acoust. Speech Signal Process. 32, 1109-1121, 1984 (hereinafter referred to as reference 1). However, such solutions of speech enhancement have some disadvantages. Speech enhancement only suppresses backgrounds represented by stationary noises, i.e., noisy sounds with time-invariant spectral characteristics.

Another known solution is called online source separation. One exemplary method was discussed in the reference written by L. S. R. Simon and E. Vincent, "A general framework for online audio source separation," in International conference on Latent Variable Analysis and Signal Separation, Tel-Aviv, Israel, March 2012 (hereinafter referred to as reference 2). A solution of online source separation allows dealing with non-stationary backgrounds, which normally is based on advanced spectral models of both sources: the speech and the background. However, the online source separation depends strongly on the fact whether the source models represent well the actual sources to be separated.

Consequently, there remains a need to improve the noise suppression in an audio communication for separating the speech data from the background data of the audio communication so that the speech quality can be improved.

SUMMARY

This invention disclosure describes an apparatus and a method for separating speech data from background data in an audio communication.

According to a first aspect, method for separating speech data from background data in an audio communication is suggested. The method comprises: applying a speech model to the audio communication for separating the speech data from the background data of the audio communication; and updating the speech model as a function of the speech data and the background data during the audio communication.

In an embodiment, the updated speech model is applied to the audio communication.

In an embodiment, a speech model which is in association with the caller of the audio communication is applied as a function of the calling frequency and calling duration of the caller.

In an embodiment, a speech model which is not in association with the caller of the audio communication is applied as a function of the calling frequency and calling duration of the caller.

In an embodiment, the method further comprises storing the updated speech mode after the audio communication for using in the next audio communication with the user.

In an embodiment, the method further comprises changing the speech model to be in association with the caller of the audio communication after the audio communication as a function of the calling frequency and calling duration of the caller.

According to a second aspect, an apparatus for separating speech data from background data in an audio communication is suggested. The apparatus comprises: an applying unit for applying a speech model to the audio communication for separating the speech data from the background data of the audio communication; and an updating unit for updating the speech model as a function of the speech data and the background data during the audio communication.

In an embodiment, the applying unit applies the updated speech model to the audio communication.

In an embodiment, the applying unit applies a speech model which is in association with the caller of the audio communication as a function of the calling frequency and calling duration of the caller.

In an embodiment, the applying unit applies a speech model which is not in association with the caller of the audio communication as a function of the calling frequency and calling duration of the caller.

In an embodiment, the apparatus further comprises a storing unit for storing the updated speech mode after the audio communication for using in the next audio communication with the user.

In an embodiment, the apparatus further comprises a changing unit for changing the speech model to be in association with the caller of the audio communication after the audio communication as a function of the calling frequency and calling duration of the caller.

According to a third aspect, a computer program product downloadable from a communication network and/or recorded on a medium readable by computer and/or executable by a processor is suggested. The computer program comprises program code instructions for implementing the steps of the method according to the second aspect of the invention disclosure.

According to a fourth aspect, a non-transitory computer-readable medium comprising a computer program product recorded thereon and capable of being run by a processor is suggested. The non-transitory computer-readable medium includes program code instructions for implementing the steps of the method according to the second aspect of the invention disclosure.

It is to be understood that more aspects and advantages of the invention will be found in the following detailed description of the present invention.

BRIEF DESCRIPTION OF THE DRAWINGS

The accompanying drawings are included to provide further understanding of the embodiments of the invention together with the description which serves to explain the principle of the embodiments. The invention is not limited to the embodiments.

In the drawings.

DETAILED DESCRIPTION

An embodiment of the present invention will now be described in detail in conjunction with the drawings. In the following description, some detailed descriptions of known functions and configurations may be omitted for conciseness.

Figure 1:
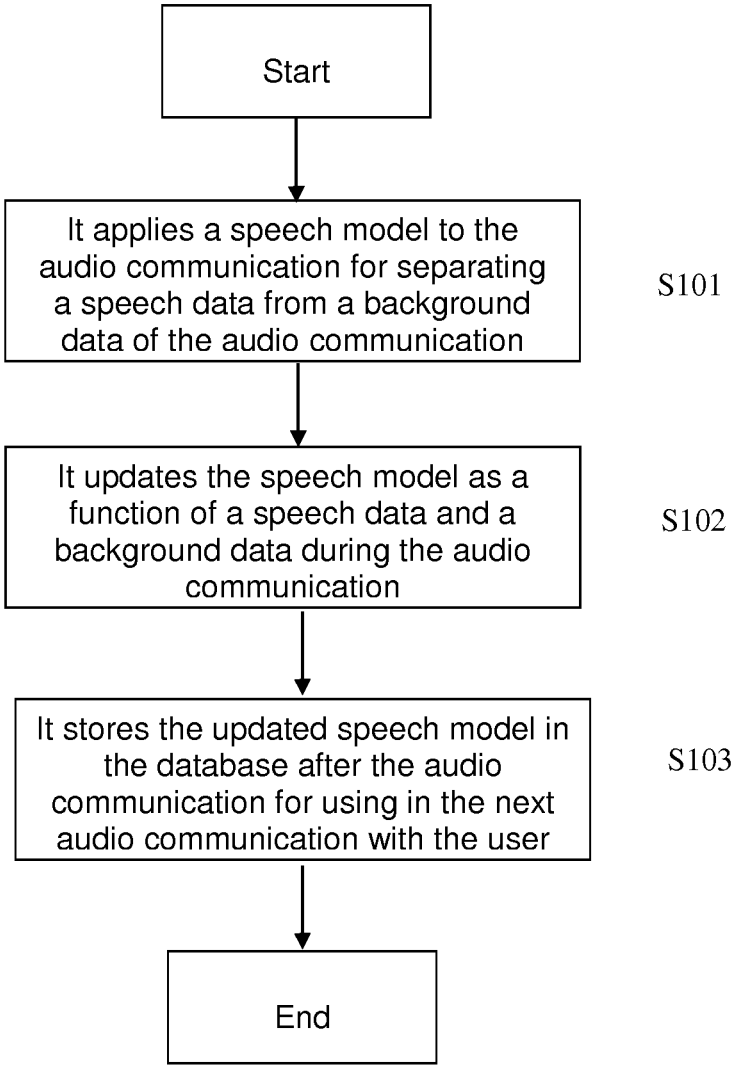
FIG. 1 is a flow chart showing a method for separating speech data from background data in an audio communication according to an embodiment of the invention.

FIG. 1 is a flow chart showing a method for separating speech data from background data in an audio communication according to an embodiment of the invention.

As shown in FIG. 1, at step S101, it applies a speech model to the audio communication for separating speech data from background data of the audio communication.

The speech model can use any known audio source separation algorithms to separate the speech data from the background data of the audio communication, such as the one described in the reference written by A. Ozerov, E. Vincent and F. Bimbot, "A general flexible framework for the handling of prior information in audio source separation," IEEE Trans. on Audio, Speech and Lang. Proc., vol. 20, no. 4, pp. 1118-1133, 2012 (hereinafter referred to as reference 3). In this sense, the term "model" here refers to any algorithm/method/approach/processing in this technical field.

The speech model can also be a spectral source model which can be understood as a dictionary of characteristic spectral patterns describing the audio source of interest (here the speech or the speech of a particular speaker). For example, for nonnegative matrix factorization (NMF) source spectral model, these spectral patterns are combined with non-negative coefficients to describe the corresponding source (here speech) in the mixture at a particular time frame. For Gaussian mixture model (GMM) source spectral model, only one most likely spectral pattern is selected to describe the corresponding source (here speech) in the mixture at a particular time frame.

The speech model can be applied in association with the caller of the audio communication. For example, the speech model is applied in association with the caller of the audio communication according to the previous audio communications of this caller. In this case, the speech model can be called a "speaker model". The association can be based on the ID of the caller, for example, the phone number of the caller.

A database can be built to contain N speech models corresponding to the N callers in the calling history of audio communication.

Upon an initiation of the audio communication, a speaker model assigned to a caller can be selected from the database and applied to the audio communication. The N callers can be selected from all the callers in the calling history based on their calling frequencies and total calling durations. That is, a caller who calls more frequently and has longer accumulated calling durations will have the priority for being included into the list of N callers allocated with a speaker model. The number N can be set depending on the memory capacity of the communication device used for the audio communication, which for example can be 5, 10, 50, 100, and so on.

A generic speech model, which is not in association with the caller of the audio communication, can be assigned to a caller who is not in the calling history according to the calling frequency or the total calling duration of the user. That is, a new caller can be assigned with a generic speech model. A caller who is in the calling history but does not call quite often can also be assigned with a generic speech model.

Similar to the speaker model, the generic speech model can be any known audio source separation algorithms to separate the speech data from the background data of the audio communication. For example, it can be a source spectral model, or a dictionary of characteristic spectral patterns for some popular models like NMF or GMM. The difference between the generic speech model and the speaker model is that the generic speech model is learned (or trained) offline from some speech samples, such as a dataset of speech samples from many different speakers. As such, while a speaker model tend to describe the speech and the voice of a particular caller, a generic speech model tends to describe the human speech in general without focusing on a particular speaker.

Several generic speech models can be set to correspond to different classes of speakers, for example, in term of male/female and/or adult/child. In this case, a speaker class is detected to determine the speaker's gender and/or average age. According to the result of the detection, a suitable generic speech model can be selected.

At step S102, it updates the speech model as a function of speech data and background data during the audio communication.

Generally, the above adaptation can be based on the detection of a "speech only (noise free)" segment and a "background only" segment of the audio communication using known spectral source models adaptation algorithms. A more detailed description in this respect will be given below with reference to a specific system.

The updated speech model will be used for the current audio communication.

The method can further comprise a step S103 of storing the updated speech model in the database after the audio communication for using in the next audio communication with the user. In the case that the speech model is the speaker model, the updated speech model will be stored in the database if there is enough space in the database. If the speech model is the speaker model, the method can further comprise storing the updated the generic speech model in the database as a speech model, for example, according to the calling frequency and the total calling duration.

According to the method of the embodiment, upon an initiation of an audio communication, it will first check whether a corresponding speaker model is already stored in the database of speech models, for example, according to the caller ID of the incoming call. If a speaker model is already in the database, the speaker model will be used as a speech model for this audio communication. The speaker model can be updated during the audio communication. This is because, for example, the caller's voice may change due to some illness.

If there is no corresponding speaker model stored in the database of speech models, a generic speech model will be used as a speech model for this audio communication. The generic speech model can also be updated during the call to fit better this caller. For a generic speech model, it can determine whether the generic speech model can be changed into a speaker model in association with the caller of the audio communication at the end of call. For example, if it is determined that the generic speech model should be changed into a speaker model of the caller, for example, according to the calling frequency and total calling duration of the caller, this generic speech model will be stored in the database as a speaker model in association with this caller. It can be appreciated that if the database has a limited space, one or more speaker models which became less frequent can be discarded.

Figure 2:
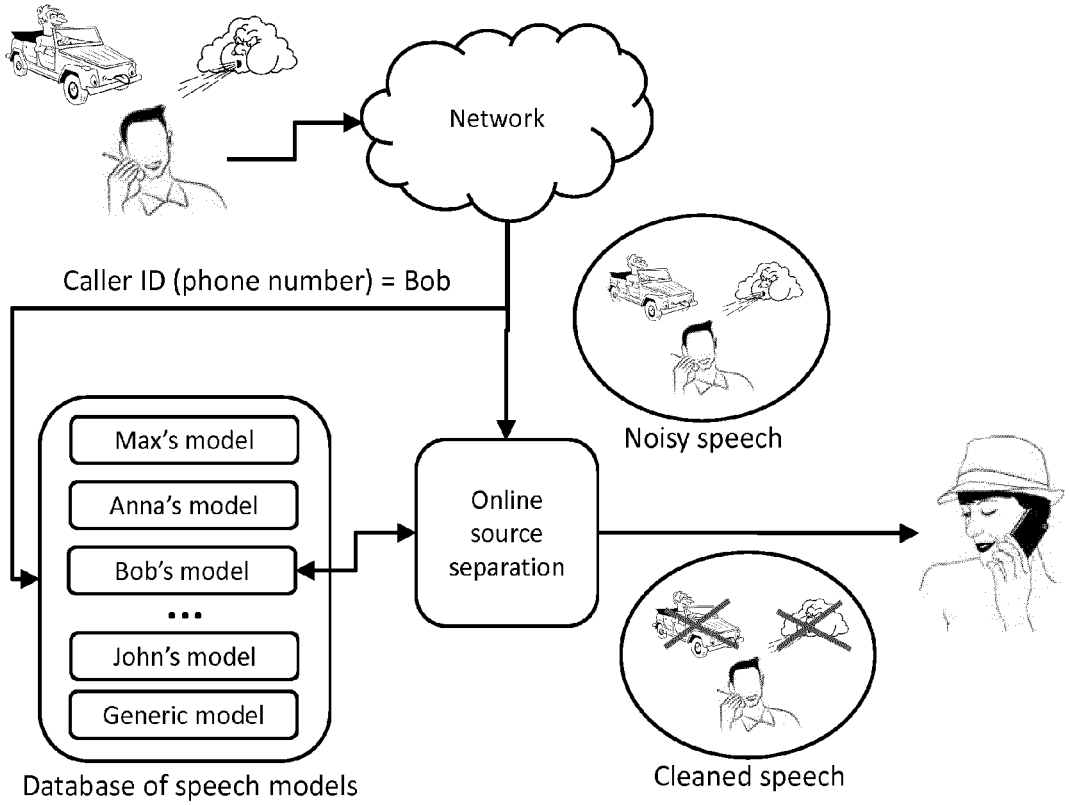
FIG. 2 illustrates an exemplary system in which the disclosure may be implemented.

FIG. 2 illustrates an exemplary system in which the disclosure can be implemented. The system can be any kind of communication systems which involve an audio communication between two or more parties, such as a telephone system or a mobile communication system. In the system of FIG. 2, a far-end implementation of an online source separation is described. However, it can be appreciated that the embodiment of the invention can also be implemented in other manners, such as a near-end implementation.

As shown in FIG. 2, the database of speech models contains the maximum of N speaker models. As shown in FIG. 2, the speaker models are in association with respective callers, such as Max's model, Anna's model, Bob's model, John's model and so on.

As for the speaker models, the total call durations for all previous callers are accumulated according to their IDs. By "total call duration" for each caller, it means the total time that this caller was calling, i.e., "time_call_1+time_call_2+ . . . +time_call_K". Thus, in some sense the "total call duration" reflects both the information call frequency and the call duration of the caller. The call durations are used to identify the most frequent callers for allocating with a speaker model. In an embodiment, the "total call duration" can be computed only within a time window, for example, within the past 12 months. This will help discarding speaker models of those callers who were calling a lot in the past but not calling any more for a while.

It can be appreciated that other algorithms can also apply for identifying the most frequent callers. For example, a combination of the calling frequency and/or calling time can be considered for this purpose. No further details will be given.

As shown in FIG. 2, the database also contains a generic speech model which is not in association with a specific caller of the audio communication. The generic speech model can be trained from some speech signals dataset.

When a new call is entering, a speech model is applied from the database by using either a speaker model corresponding to the caller or a generic speech model which is not speaker-dependent.

As shown in FIG. 2, when Bob is calling, a speaker model "Bob's model" is selected from the database and applied to the call since this speaker model is allocated to Bob according to the calling history.

In this embodiment, the Bob's model can be a background source model which is also a source spectral model. The background source model can be a dictionary of characteristic spectral patterns (e.g., NMF or GMM). So the structure of the background source model can be exactly the same as the speech source model. The main difference is in the model parameters values, e.g., the characteristic spectral patterns of background model should describe the background, while the characteristic spectral patterns of speech model should describe the speech.

Figure 3:
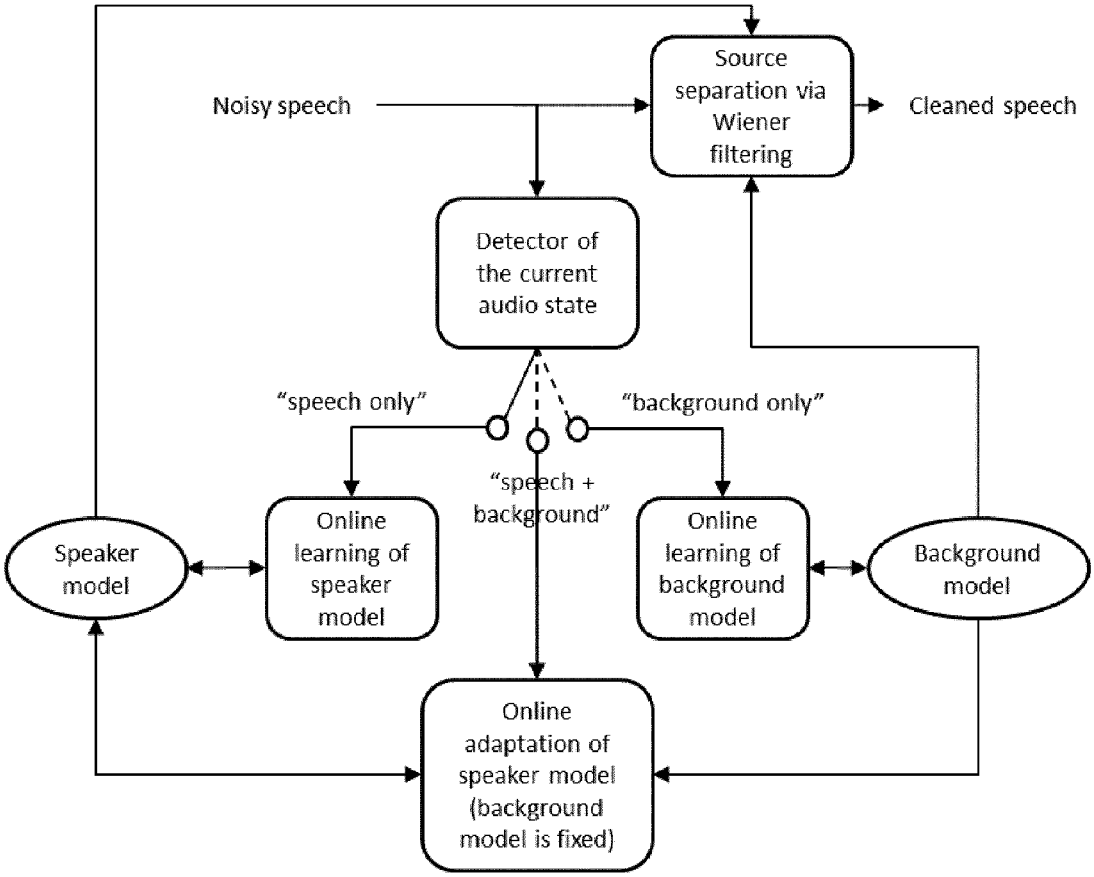
FIG. 3 is a diagram showing an exemplary process for separating speech data from background data in an audio communication.

FIG. 3 is a diagram showing an exemplary process for separating speech data from background data in an audio communication.

In the process illustrated in FIG. 3, during the calling, the following steps are performed:

1. A detector is launched for detecting the current signal state among the following three states:

a. Speech only.

b. Background only.

c. Speech+background.

Known detectors in this art can be used for the above purpose, for example, the detector discussed in the reference written by Shafran, I. and Rose, R. 2003, "Robust speech detection and segmentation for real-time ASR applications", In Proceedings of IEEE International Conference no Acoustics, Speech, and Signal Processing (ICASSP). Vol. 1. 432-435.) (hereinafter referred to as reference 4). As many other approaches on audio event detection, this approach relies mainly on the following steps. The signal is cut into temporal frames, and some features, e.g., the vectors of Mel-frequency cepstral coefficients (MFCC), are computed for each frame. A classifier, e.g., one based on several GMMs, each GMM representing one event (here there are three events: "speech only", "background only" and "speech+background"), is then applied to each feature vector to detect the corresponding audio event at the given time. This classifier, e.g., the one based on GMMs, needs to be pre-trained offline from some audio data, where the audio event labels are known (e.g., labeled by a human).

2. In the "Speech only" state, the speaker source model is learned online, for example, using the algorithm described in the reference 2. Online learning means that the model (here speaker model) parameters need to be continuously updated along with new signal observations available within the call progress. In other words, the algorithm can use only past sound samples and should not store too much of previous sound samples (this is due to the device memory constraints). According to the approach described in the reference 2, the speaker model (which is an NMF model according to the reference 2) parameters are smoothly updated using statistics extracted from a small fixed number (for example, 10) of most recent frames.

3. In the "Background only" state, the background source model is learned online, for example, using the algorithm described in the reference 2. This online background source model learning is performed exactly as for the speaker model, as described in the previous item.

4. In the "Speech+background" state, the speaker model is adapted online, assuming the background source model is fixed, for example, using the algorithm described in Z. Duan, G. J. Mysore, and P. Smaragdis, "Online PLCA for real-time semi-supervised source separation," in International Conference on Latent Variable Analysis and Source Separation (LVA/ICA). 2012, Springer (hereinafter referred to as reference 5). The approach is similar to the one explained in the above steps 2 and 3. The only difference between them is that this online adaptation is performed from the mixture of the sources ("speech+background"), instead of the clean sources ("speech only or background only"). For the above purpose, the process similar to the online learning (items 2 and 3) is applied. The difference is that, in this case, the speaker source model and the background source model are decoded jointly and the speaker model is continuously updated, while the background model is kept fixed.

Alternatively, the background source model can be adapted, assuming that the speaker source model is fixed. However, it could be more advantageous to update the speaker source model, since in a "usual noisy situation" it is often more probable to have speech-free segments ("Background only" detections) than background-free segments ("Speech only" detections). In other words, the background source model can be well-trained enough (on the speech-free segments). Thus it could be more advantageous to adapt the speaker source model on "Speech+background" segments.

5. Finally, source separation is continuously applied to estimate the clean speech (see FIG. 3). This source separation process is based on the Wiener filter, which is an adaptive filter with the parameters estimated from the two models (the speaker source model and the background source model) and the noisy speech. The references 2 and 5 give more details in this respect. No further information will be provided.

At the end of the call, the following steps are performed:

1. The total call duration for this user is updated. This can be simply done by incrementing this duration if it was already stored or by initializing it by the current call duration if this user calls for the first time.

2. If the speech model of this speaker was already in the database of models, it is updated in the database.

3. Otherwise, if the speech model was not in the database, the speech model is added to the database only if the database consists of less than N speaker models or if this speaker is in the top N call durations among others (in any case, the model of the less frequent speaker is removed from the database so as there are always maximum N models in it).

Note that invention relies on the hypothesis that the same phone number is used by the same person, which is usually the case for mobile phones. For home stationary phones that may be less true, since, e.g., all family members may use such a phone. However, in the case of home phones background suppression is not so crucial. Indeed, it is often possible to simply shut down the music or ask other people speaking quietly. In other words, in most cases, when background suppression is necessary, this hypothesis holds, and, if it is not (indeed, one can borrow a mobile phone of some other person to speak), the proposed system will not fail either thanks to a continuous speaker model re-adaptation to new conditions.

Figure 4:
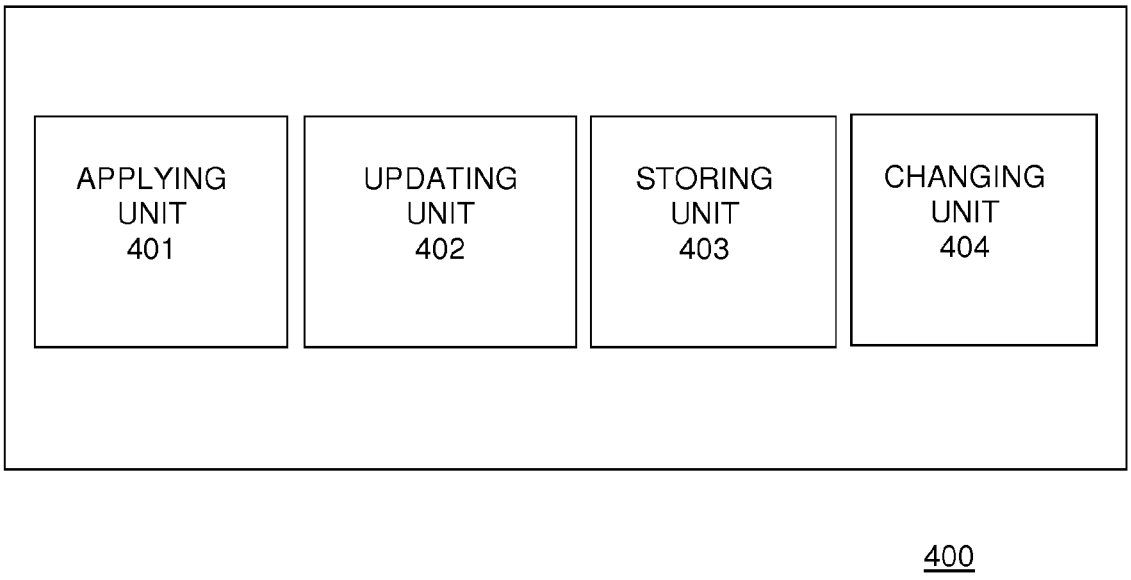
FIG. 4 is a block diagram of an apparatus for separating speech data from background data in an audio communication according to an embodiment of the invention.

An embodiment of the invention provides an apparatus for separating speech data from background data in an audio communication. FIG. 4 is a block diagram of the apparatus for separating speech data from background data in an audio communication according to the embodiment of the invention.

As show in FIG. 4, the apparatus 400 for separating speech data from background data in an audio communication comprises an applying unit 401 for applying a speech model to the audio communication for separating the speech data from the background data of the audio communication; and an updating unit 402 for updating the speech model as a function of speech data and background data during the audio communication.

The apparatus 400 can further comprise a storing unit 403 for storing the updated speech model after the audio communication for using in the next audio communication with the user.

The apparatus 400 can further comprise a changing unit 404 for changing the speech model to be in association with the caller of the audio communication after the audio communication as a function of the calling frequency and calling duration of the caller.

An embodiment of the invention provides a computer program product downloadable from a communication network and/or recorded on a medium readable by computer and/or executable by a processor, comprising program code instructions for implementing the steps of the method described above.

An embodiment of the invention provides a non-transitory computer-readable medium comprising a computer program product recorded thereon and capable of being run by a processor, including program code instructions for implementing the steps of a method described above.

It is to be understood that the present invention may be implemented in various forms of hardware, software, firmware, special purpose processors, or a combination thereof. Moreover, the software is preferably implemented as an application program tangibly embodied on a program storage device. The application program may be uploaded to, and executed by, a machine comprising any suitable architecture. Preferably, the machine is implemented on a computer platform having hardware such as one or more central processing units (CPU), a random access memory (RAM), and input/output (I/O) interface(s). The computer platform also includes an operating system and microinstruction code. The various processes and functions described herein may either be part of the microinstruction code or part of the application program (or a combination thereof), which is executed via the operating system. In addition, various other peripheral devices may be connected to the computer platform such as an additional data storage device and a printing device.

It is to be further understood that, because some of the constituent system components and method steps depicted in the accompanying figures are preferably implemented in software, the actual connections between the system components (or the process steps) may differ depending upon the manner in which the present invention is programmed. Given the teachings herein, one of ordinary skill in the related art will be able to contemplate these and similar implementations or configurations of the present invention.

The invention claimed is:

1. A method for separating speech data from background data in an audio communication, comprising:

applying a spectral speech model to the audio communication for separating the speech data from the background data of the audio communication; and updating the spectral speech model as a function of the speech data and the background data during the audio communication.

2. The method according to claim 1, wherein the updated spectral speech model is applied to the audio communication.

3. The method according to claim 1, wherein a spectral speech model associated with a caller of the audio communication is applied as a function of a calling frequency and a calling duration of the caller.

4. The method according to claim 1, wherein a spectral speech model which is not associated with a caller of the audio communication is applied as a function of a calling frequency and a calling duration of the caller.

5. The method according to claim 1, further comprising:

storing the updated spectral speech model after the audio communication for using in a next audio communication.

6. The method according to claim 4, further comprising:

changing the spectral speech model to be associated with the caller of the audio communication after the audio communication as a function of the calling frequency and the calling duration of the caller.

7. Computer program product which is stored on a non-transitory computer readable medium and comprises program code instructions executable by a processor for implementing the steps of a method according to claim 1.

8. An apparatus for separating speech data from background data in an audio communication, comprising:

an applying unit for applying a spectral speech model to the audio communication for separating the speech data from the background data of the audio communication; and an updating unit for updating the spectral speech model as a function of the speech data and the background data during the audio communication.

9. The apparatus according to claim 8, wherein the applying unit is configured to apply the updated spectral speech model to the audio communication.

10. The apparatus according to claim 8, wherein the applying unit is configured to apply a spectral speech model which is associated with a caller of the audio communication as a function of a calling frequency and a calling duration of the caller.

11. The apparatus according to claim 8, wherein the applying unit is configured to apply a spectral speech model which is not associated with a caller of the audio communication as a function of a calling frequency and a calling duration of the caller.

12. The apparatus according to claim 8, further comprising:

a storing unit configured to store the updated spectral speech model after the audio communication for using in a next audio communication.

13. The apparatus according to claim 11, further comprising:

a changing unit configured to change the spectral speech model to be associated with the caller of the audio communication after the audio communication as a function of the calling frequency and the calling duration of the caller.

* * * * *